US006474281B1

(12) United States Patent
Walters

(10) Patent No.: US 6,474,281 B1
(45) Date of Patent: Nov. 5, 2002

(54) VALVE CONTROL MECHANISM

(76) Inventor: Christopher P. Walters, East Kingston House, Kingston Lane, East Preston, Littlehampton, West Sussex BN16 1RS (GB)

( * ) Notice: Subject to any disclaimer, the term of this patent is extended or adjusted under 35 U.S.C. 154(b) by 0 days.

(21) Appl. No.: 09/429,617

(22) Filed: Oct. 29, 1999

(30) Foreign Application Priority Data

Oct. 30, 1998 (GB) ..... 9823816
Nov. 6, 1998 (GB) ..... 9824438

(51) Int. Cl.[7] ..... F01L 1/34; F02D 13/02

(52) U.S. Cl. ..... 123/90.18; 123/90.17; 123/90.5

(58) Field of Search ..... 123/90.15, 90.17, 123/90.18, 90.31, 90.48, 90.5

(56) References Cited

U.S. PATENT DOCUMENTS

| | | | | | |
|---|---|---|---|---|---|
| 3,712,277 | A | * | 1/1973 | Piatti | 123/90.22 |
| 4,850,311 | A | | 7/1989 | Sohn | |
| 5,070,827 | A | * | 12/1991 | Krieg et al. | 123/90.48 |
| 5,329,895 | A | * | 7/1994 | Nishida et al. | 123/90.17 |
| 5,673,661 | A | * | 10/1997 | Jesel | 123/90.48 |
| 5,803,030 | A | * | 9/1998 | Cole | 123/90.17 |
| 5,870,984 | A | * | 2/1999 | Hasegawa et al. | 123/90.18 |
| 5,881,690 | A | * | 3/1999 | Park | 123/90.18 |
| 5,924,397 | A | * | 7/1999 | Moriya et al. | 123/90.18 |
| 5,988,128 | A | * | 11/1999 | Moriya et al. | 123/90.18 |
| 6,131,541 | A | * | 10/2000 | Hasegawa et al. | 123/90.18 |

FOREIGN PATENT DOCUMENTS

| | | |
|---|---|---|
| EP | 0 590 577 A1 | 4/1994 |
| EP | 0 838 576 A1 | 4/1998 |
| EP | 0 843 080 A1 | 5/1998 |
| GB | 2190140 | 11/1987 |
| GB | 2229514 | 9/1990 |
| JP | 09032519 | 4/1997 |

* cited by examiner

*Primary Examiner*—Weilun Lo
(74) *Attorney, Agent, or Firm*—Browdy and Neimark, P.L.L.C.

(57) ABSTRACT

A valve control mechanism is disclosed which permits either or both of (a) axial displacement of the camshaft of an internal combustion engine, and (b) phasing of the camshaft (and hence of the valve operation)—i.e. an advance/retard function. The mechanism preferably includes a piston housed within a cylinder, this arrangement itself being mounted within a front end camshaft pulley. The piston is under hydraulic control, preferably governed by a micro-processor. A mechanical coupling between the piston and the camshaft translates the axial movement of the piston into one or both of axial displacement of the camshaft and relative advancement/retardation of its rotation.

21 Claims, 3 Drawing Sheets

VALVE CONTROL MECHANISM

BACKGROUND TO THE INVENTION

This invention relates to a valve control mechanism for an internal combustion engine, to engines containing such mechanisms and to a method of operating the valves of an internal combustion engine.

Our British Patent No. 2 190 140 describes and claims a valve control mechanism which comprises: a camshaft carrying a plurality of cams, the camshaft being mounted in a cam carrier and being arranged for a limited degree of axial movement and having associated with it means for effecting such movement, each of the cam surfaces having an outline, in a section plane containing the axis of the camshaft, which is not parallel to that axis, whereby in use the valve action is a function of the axial location of the camshaft within the range of permitted axial movement, the mechanism also comprising a cam follower for each cam, the cam follower comprising a one-piece body which reciprocates within a slideway and at one extremity acts upon the end of a valve stem through only a shim and has at the opposite extremity a trough of part-circular cross-section which receives a member in the form of a segment of a circular cylinder, the curved surface of which faces the interior surface of the trough, so that said member can turn with respect to said body, whilst a planar side surface of the member faces the cam surface. The present invention offers developments derived from this earlier valve control mechanism.

SUMMARY OF THE INVENTION

According to one aspect of the present invention, there is provided, in or for use in an internal combustion engine, a valve control mechanism which comprises: a camshaft carrying a plurality of cams, the camshaft being mounted in, or being adapted to be mounted in, a cylinder head or cam carrier, the valve control mechanism further including means for relatively advancing and retarding the rotation of the camshaft, said advance/retard means comprising a piston housed and axially displaceable within a cylinder, the axial position of said piston being under hydraulic control, and a mechanical coupling between said piston and the camshaft, said mechanical coupling serving to translate the axial movement of said piston into relative rotational movement of said camshaft.

The piston and cylinder may be, housed within a camshaft pulley at the front end of the camshaft. In one embodiment, the cylinder is defined, at its front end, by a front plate having an annular flange extending towards the camshaft; and at its rear end by the front face of a housing within which said mechanical coupling is housed.

Advantageously, the mechanical coupling between the piston and the camshaft comprises a spline mechanism acting between said piston and the front end of said camshaft. Such a spline mechanism may be mounted within a housing, the front end surface of said housing forming the rear wall of said cylinder, as indicated above.

It will be appreciated that the configuration described is such that axial displacement of said piston causes a corresponding degree of rotational advancement of the camshaft when the axial movement is in one direction and a limited degree of rotational retardation of the camshaft when the axial movement is in the opposite direction.

Preferably, a first channel is provided to deliver hydraulic fluid to the interior of said cylinder directly behind said front plate, and a second channel is provided to deliver hydraulic fluid to said cylinder directly in front of the housing for said mechanical coupling.

In certain currently preferred embodiments of the invention, the piston is arranged so that its own axial displacement results additionally in axial displacement of the camshaft.

In a valve control mechanism in accordance with the invention, each cam generally has associated therewith a cam follower. Preferably, each cam follower comprises a body which reciprocates within a slideway and at one extremity acts upon the end of a valve stem, the cam follower having at its opposite extremity a trough of curved cross-section which receives a member in the form of a segment having on one side thereof a surface curved correspondingly to that of said trough, and having on the other side thereof a planar surface, whereby the curved surface of the segment enables said member to turn with respect to said body, while the planar surface of the member cooperates with the cam surface.

Preferably, the cam followers are disposed relative to the valve stems such that the One of action between the each cam follower and the end of its respective valve stem is located away from the mid-point (measured in a direction parallel to the axis of the camshaft) of a section through the cam fallower in a plane which contains the axis of the camshaft and the axis of the valve stem. A particularly preferred arrangement is where said end of the valve stem is partly recessed within the body of the cam follower.

In this first aspect of the invention, and in other aspects also, the hydraulic control of the piston action is preferably under microprocessor control.

According to a second aspect of the present invention, there is provided, in or for use in an internal combustion engine, a valve control mechanism which comprises: a camshaft carrying a plurality of cams, the camshaft being mounted in a cylinder head or cam carrier and being arranged for a limited degree of axial movement and having associated with it means for effecting such movement, each of the cam surfaces having an outline in section taken through a plane containing the axis of the camshaft which is not parallel to that axis, whereby in use the valve action is a function of the axial location of the camshaft within the range of permitted axial movement; and a cam follower for each cam, the cam follower comprising a body which reciprocates within a slideway and at one extremity acts upon the end of a valve stem, the cam follower having at its opposite extremity a trough of part-circular cross-section which receives a member in the form of a segment of a circular cylinder, the curved surface of which faces the interior surface of the trough, so that said member can turn with respect to said body; while a planar side surface of the member faces the cam surface, In this second aspect, the valve control mechanism may further comprise means for relatively advancing and retarding the rotation of the camshaft.

In one embodiment of this second aspect of the invention, control of the axial displacement of the camshaft acts also to control the relative rotational adjustment of the camshaft. This provides good control of valve action and can be implemented relatively easily. In an alternative embodiment, control of the axial displacement of the camshaft acts independently of the relative rotational adjustment of the camshaft. This permits greater freedom to influence valve action, but requires more control functions within or associated with the engine.

Advantageously, the means for effecting the limited degree of axial displacement of the camshaft comprises a piston housed within a cylinder, the axial position of the piston being under hydraulic control. Such hydraulic control of said piston is preferably governed by a microprocessor. This may be achieved, for example, by use of oil supplied by a proportional programmable valve such as "Moog" valve under microprocessor control.

In one implementation of this aspect of the invention, the piston can advantageously act on the camshaft to effect axial displacement thereof through a spline mounted within a housing, the arrangement being such that axial displacement of the piston causes one or both of: (a) a corresponding degree of axial displacement of the spline and of the camshaft; and (b) a limited degree of rotational advancement of the camshaft when the axial movement is in one direction and a limited degree of rotational retardation of the camshaft when the axial movement is in the opposite direction. The spline may for example be a straight spline or a ball spline.

In order to reduce the bulk of an engine incorporating a valve control mechanism of this invention, the piston, cylinder and spline may be positioned at the front end of the camshaft, the conventional front end camshaft bearing being modified as will be described herein.

It will be appreciated that the features described above permit control of the valve lift and duration with different cam profiles varying infinitely within two limits (through the axial displacement of the camshaft) and of the valve timing (through the rotational adjustment of the camshaft). When these three functions operate together, the duration of valve opening, their angular shift and the envelope of the curve obtained by plotting valve position against time In a further embodiment, the profile of each cam is such that a line connecting the points of maximum radial extent of the cam at opposite ends (in the to the axis of the camshaft. Cams of this type of profile are described as swashed cams. When viewed in the direction of the camshaft axis, cams of this sort display a phase angle between the camshaft axis and the line marking the "noses" of the cam profile. Using cams of this structure allows more extended control of valve action, in particular timing, when the camshaft undergoes axial displacement.

Another aspect of the present invention addresses the structure of cam follower used, in particular its cooperation with the end of the valve stem. Accordingly, the present invention also provides, in or for use in an internal combustion engine, a valve control mechanism which comprises: a camshaft carrying a plurality of cams, the camshaft being mounted in a cylinder head or cam carrier and being arranged for a limited degree of axial movement and having associated with it means for effecting such movement, each of the cam surfaces having an outline in section taken through a plane containing the axis of the camshaft which is not parallel to that axis, whereby in use the valve action is a function of the axial location of the camshaft within the range of permitted axial movement; and a cam follower for each cam the cam follower comprising a body which reciprocates within a slideway and at one extremity acts upon the end of a valve stem, the cam follower having at its opposite extremity a trough of part-circular cross-section which receives a member in the form of a segment of a circular cylinder, the curved surface of which faces the interior surface of the trough, so that said member can turn with respect to said body, while a planar side surface of the member faces the cam surface; wherein the cam followers are disposed relative to the valve stems such that the zone of action between each cam follower and the end of its respective valve stem is located away from the mid-point (measured in a direction parallel to the axis of the camshaft) of a section through the cam follower in a plane which contains the axis of the camshaft and the axis of the valve stem: The end of the valve stem may be partly recessed within the body of the cam follower.

It will be appreciated that, in use, lubrication will be fed to the member in the form of a segment of a circular cylinder to reduce frictional effects when the member moves with respect to the trough in which it sits.

The invention also provides an internal combustion engine in which there is a camshaft carrying a plurality of cams and a cam follower for each cam, the cam follower comprising a body which reciprocates within a slideway and at one extremity acts upon the end of a valve stem, wherein the cam followers are disposed relative to the valve stems such that the zone of action between each cam follower and the end of its respective valve stem is located away from the mid-point (measured in a direction parallel to the axis of the camshaft) of a section through the cam follower in a plane which contains the axis of the camshaft and the axis of the valve stem. Preferably, the zone of action is located close to one side of the cam follower.

There are several unexpected advantages in utilising a cam follower of the type defined above; firstly, this type of mechanism packaging allows this device to operate within a currently packaged conventional engine size envelope. This in turn:-means that valve control mechanisms of this invention can be incorporated into standard production engines with minimum modification.

Secondly, the tendency of conventional cam profiles and followers to become damaged due to the force of the valve stem acting on the follower surface in such a way as to tip it relative to the cam lobe and produce uneven elastic deformation, leading to much higher local stresses and hence wear, is avoided due to improved cam/follower contact.

Thirdly, the cam follower can be configured to maximise its structural rigidity/mass ratio, thereby permitting improved valve gear and engine performance.

A valve control mechanism in accordance with this aspect of the invention can have the end of the valve stem partly recessed within the body of the cam follower.

According to a fourth aspect of the present invention, there is provided, in or for use in an internal combustion engine, a valve control mechanism which comprises: a camshaft carrying a plurality of cams, the camshaft being mounted in a cylinder head or cam carrier and being arranged for a limited degree of axial movement and having associated with it means for effecting such movement, each of the cam surfaces having an outline in section taken through a plane containing the axis of the cammshaft which is not parallel to that axis, whereby in use the valve action is a function of the axial location of the camshaft within the range of permitted axial movement; and a cam follower for each cam, the cam follower comprising a body which reciprocates within a slideway and at one extremity acts upon the end of a valve stem, the cam follower having at its opposite extremity a trough of part-circular cross-section which receives a member in the form of a segment of a circular cylinder, the curved surface of which faces the interior surface of the trough, so that said member can turn with respect to said body, while a planar side surface of the member faces the cam surface; the valve control mechanism further comprising means for relatively advancing and retarding the rotation of the camshaft, and wherein the cam followers are disposed relative to the valve stems such that the zone of action between each cam follower and the end of its respective valve stem is located away from the mid-point (measured in a direction parallel to the axis of the camshaft) of a section through the cam follower in a plane which contains the axis of the camshaft and the axis of the valve stem.

According to a fifth aspect of the present invention, there is provided a method of controlling the valves in an internal combustion engine, which comprises supplying a hydraulic fluid under the control of a microprocessor to cause relative advancement and retardation of the rotation of the camshaft. Such a method permits continuously variable advance/retard control.

In this fifth aspect of the invention, the hydraulic fluid is preferably caused to act on a piston housed within a cylinder, the axial displacement of said piston acting upon the camshaft to cause relative advancement and/or retardation thereof. The piston may be arranged so that its own axial displacement results additionally in axial displacement of the camshaft. Conveniently, the piston is disposed within a camshaft pulley.

The disposition of the piston and cylinder within a camshaft pulley at the front end of an internal combustion engine provides a very effective mounting for the camshaft as well as facilitating the control functions which may be required (e.g. relative advance/retard and/or axial displacement of the camshaft).

According to a sixth aspect of the present invention, there is provided, in or for use in an internal combustion engine, a cam follower which comprises a body which, in use, reciprocates within a slideway within the engine and at one extremity acts upon the end of a valve stem, the cam follower comprising a generally rectangular, hollow body adapted at its upper end for contact with a cam and having at its lower end a contact surface for cooperation with the valve stem, characterised in that said contact surface is located so as to be contiguous with a side wall of the hollow body.

According to a seventh aspect of the present invention, there is provided, in or for use in an internal combustion engine, a cam follower which comprises a body which, in use, reciprocates within a slideway within the engine and at one extremity acts upon the end of a valve stem, the cam follower comprising a generally rectangular, hollow body adapted at its upper end for contact with a cam and having at its lower end a contact surface for cooperation with the valve stem, characterised in that the zone of action between the cam follower and the end of its respective valve stem is a contact surface which is located away from the mid-point (measured in a direction parallel to the axis of the camshaft) of a section through the cam follower in a plane which contains the axis of the camshaft and the axis of the valve stem.

Advantageously, a cam follower as defined above includes an internal wall extending upwardly from the lower end of the hollow body and parallel to the shorter sides of the body midway between the shorter sides, said internal wall including, at is junction with one of the longer sides of the body, the contact surface which, in use, makes contact with the valve stem.

BRIEF DESCRIPTION OF THE DRAWINGS

For a better undesrstanding of the invention, and to show how the same may be carried into effect, reference will now be made, by way of example, to the accompanying drawings, in which.

DETAILED DESCRIPTION OF THE DRAWINGS

Figure 1:
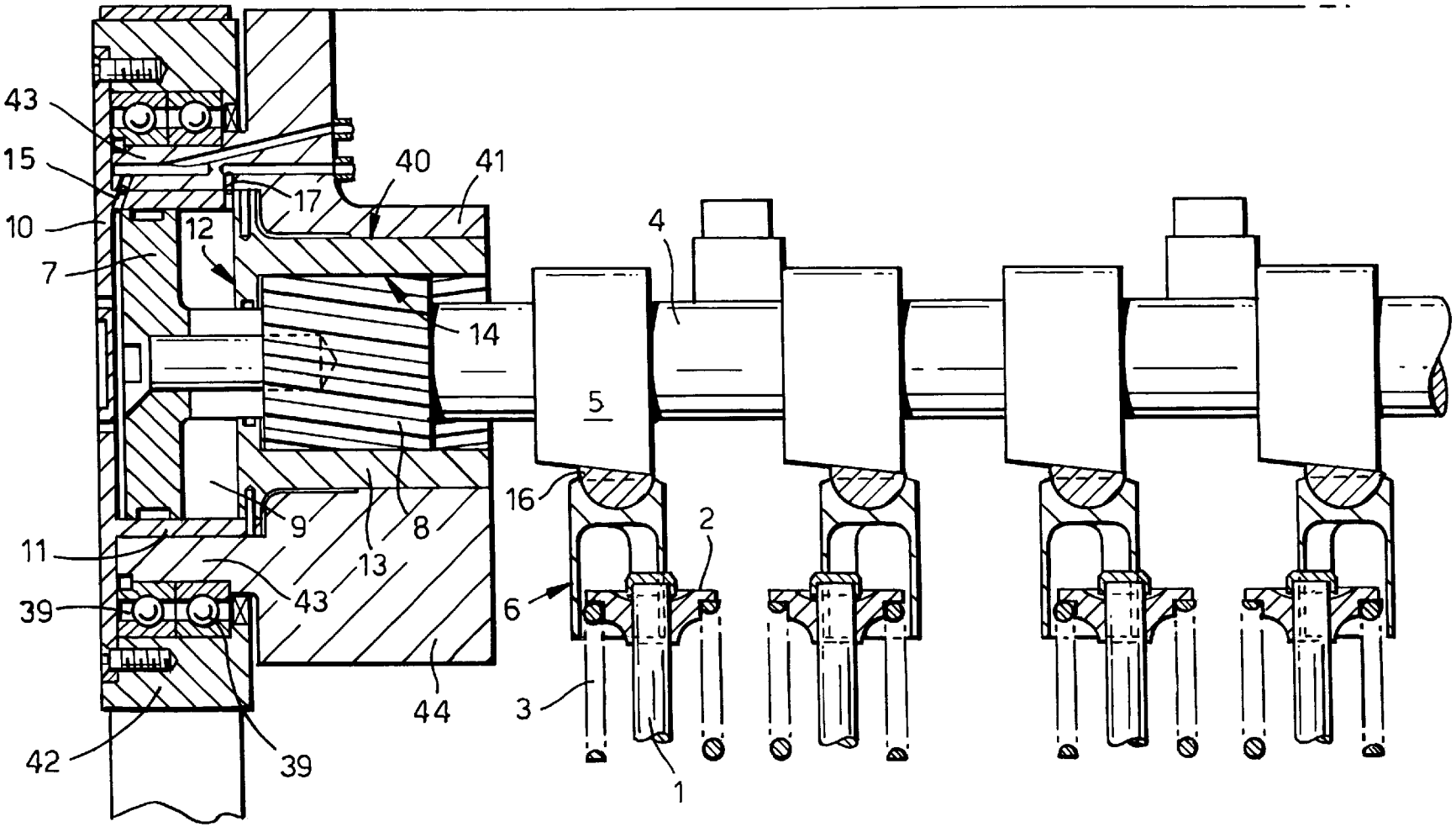
FIG. 1 is a sectional view through part of an internal combustion engine in accordance with this invention, with certain parts omitted for the sake of clarity.

Referring now to the drawings, the currently preferred valve control mechanism of this invention is depicted and comprises an overhead camshaft 4 which carries a plurality of profiled cams 5. Each of the cams 5 cooperates with a half roller 16 which sits in a recess 19 formed on the upper surface of a rectangular cam follower body 6. The half roller 16 is in the form of a segment of a circular cylinder and is free to rotate about its longitudinal axis while seated in the recess 19. Valve stem 1 cooperates with cam follower body 6 and is held in place by retainers 2 (only the upper retainer is shown, in the drawings) and compression springs 3.

The cam profiles are three dimensional, i.e. valve lift varies tangentially with cam angle in end view and varies along the camshaft linearly at each cam angle in side view. If desired, the profile of each cam may be such that a line connecting the points of maximum radial extent of the cam at opposite ends (in the direction of the camshaft axis) thereof is non-parallel to the axis of the camshaft.

The front end of camshaft 4 is connected to a piston 7 located within a cylinder 9 through the intermediary of a spline 8. The chamber of cylinder 9 is defined by a 10 front plate 10 and by an annular flange 11 integral with plate 10; the rear face 12 of the chamber is part of a housing 13 which contains the spline 8. The inner surface 14 of housing 13 is provided with a screw thread (not shown) which cooperates with spline 8 so that axial movement of the spline relative to the housing 13 causes rotation of the spline.

Housing 13 acts as a carrier for spline 8 and, through the action of bearing surface 40, constitutes an outer bearing for the front end of camshaft 4 within cylinder head or carrier 41. An inner bearing for the front end of camshaft 4 is provided by the outer diameter of splines 18 and the inner spline track diameter in 13 (see FIGS. 2 and 3). These two (outer and inner) bearings are supported on camshaft pulley bearings 39 via elements 13 and 11, and camshaft pulley 42. The camshaft pulley bearings 39 can accept radial and axial loads and provide a stiffer than conventional means of mounting the camshaft pulley on a circular ring 43 which forms part of the cylinder head structure together with parts 41 end 44.

If it is desired to use a simplified system in which piston 7 serves to effect an advance/retard action on the camshaft rotation without also causing axial displacement of the camshaft (thereby acting as a so-called phaser), then the linkage between camshaft 4 and spline 8 is modified. This may be achieved, for example, by having a further splined connection (not shown) between the front end of camshaft 4 and the interior of spline body 8 into which it fits; in this way, the axial motion of spline body 8 is "lost" by the compensating interaction of the internal spline linkage.

Figure 2:
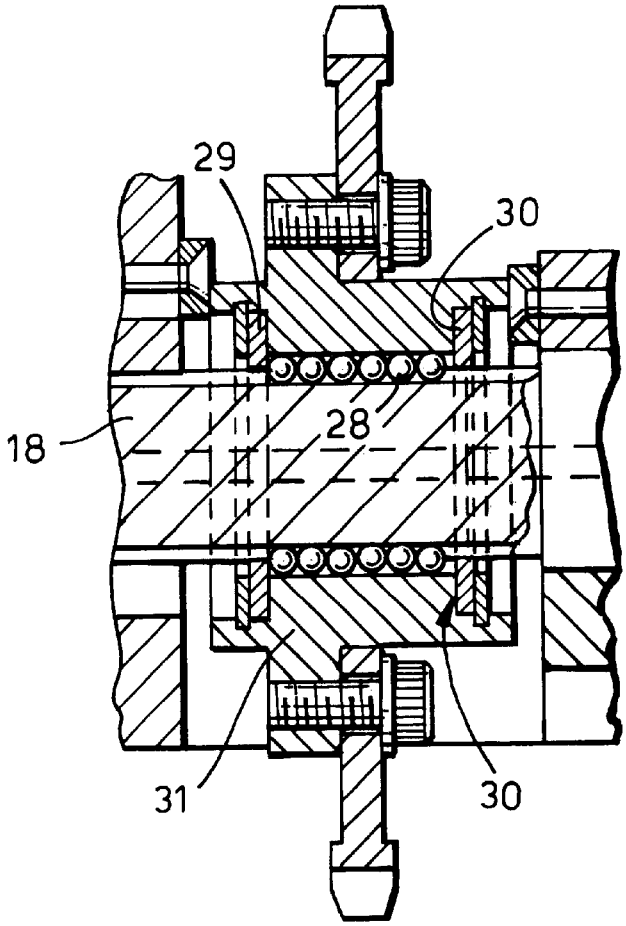
FIG. 2 shows an alternative construction for part of the engine shown in FIG. 1.
Figure 3:
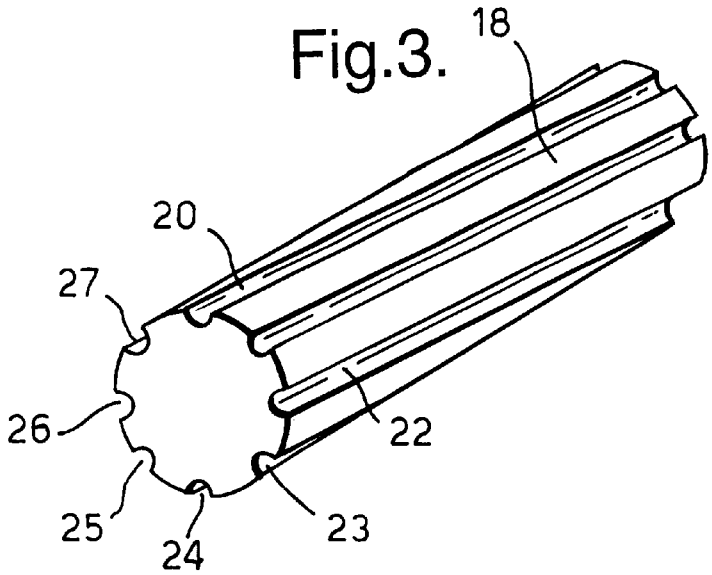
FIG. 3 shows one component of the structure illustrated in FIG. 2.
Figure 4:
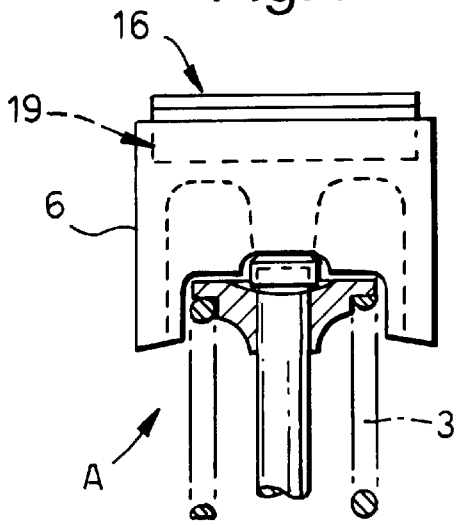
FIGS. 4 to 7 illustrate a cam follower in accordance with this invention.
Figure 5:
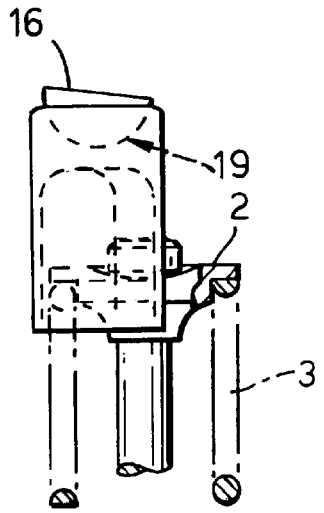
Figure 6:
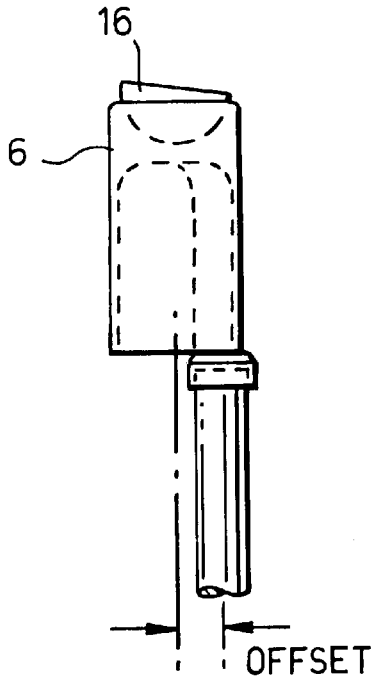

Referring now to FIGS. 2 and 3, one embodiment of the spline arrangement is shown in greater detail. In this embodiment, the spline comprises a cylinder 18 the outer surface of which is formed with a plurality of helical grooves 20–27. Eight grooves are shown in this example, although it will be appreciated that the number of grooves and their geometry will be selected according to the particular requirements of the engine.

These grooves carry bearings, e.g. ball bearings 28 (see FIG. 2). The balls 28 are held between thrust races 29 and 30; these prevent the balls from moving excessively in the axial direction. They are free to rotate around the inner surface of housing 31. Consequently axial movement of cylinder 18 results in its partial rotation which in turn imparts a controllable degree of rotational advancement or retardation to the camshaft 4, to which cylinder 18 is connected.

If desired, a double helical spline arrangement (not shown) may be employed to increase the available range of variation of valve timing. For example, a cylindrical annulus (not shown), having appropriately configured helical grooves on, its inner and outer surfaces may be interposed between spline 8, 18 and housing 31.

Axial movement of the piston 7 and spline 8, 18 is caused by the supply of oil under pressure to chamber 9 via inlets 15 and 17; oil is supplied to these inlets from proportional programmable valves, e.g. "Moog" valves (not shown). By controlling the hydraulic pressures at inlets 15 and 17, piston 7 is caused to move axially within chamber 9, thereby moving spline 8, 18 and camshaft 4 by a corresponding axial amount. This movement, in turn, causes an additional rotational movement of spline 8, 18 thereby rotationally advancing or retarding the camshaft within pre-set limits (e.g. as defined by the number and disposition of the helical grooves 20–27 formed in cylinder 18).

The effect of axial movement of camshaft 4 will be discerned from FIG. 1: movement to the left causes the valve stem 1 to rise relative to its previous position at the same point in its cycle, thus giving greater valve lift and, if desired, a change in camshaft duration. The rotational advancement imparted by spline 8, 18 additionally advances the valve timing. Movement to the right reverses these effects.

Referring now to FIGS. 4–7, cam followers in accordance with this invention are shown in greater detail.

Figure 7:
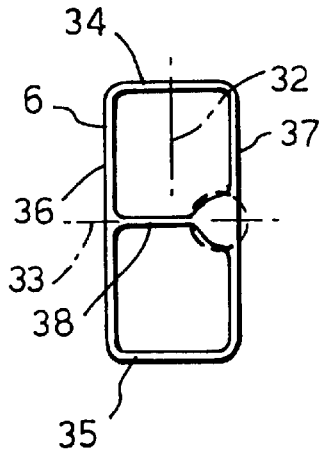

FIG. 7 illustrates a horizontal cross section through the cam follower body 6 at the zone of contact between body 6 and valve stem 1. This clearly shows how the zone of contact is not located centrally but is displaced well to the side of the mid point defined by the intersection dashed lines 32 and 33. Body 6 is rectangular and is formed of sidewall portions 34–37 and an internal wall 38. As apparent from FIGS. 4–6, the upper surface of the cam follower body 6 includes a recess 19 which forms the seating for half-roller 16.

The end of the valve stem effectively contacts a T-section portion of the body 6, as evident from FIG. 7. This form of contact provides an effective link between the cam 5 and valve stem 1 while reducing or eliminating the common tendency of cam followers to buckle due to diaphragm-like behaviour.

What is claimed is:

1. In or for use in an internal combustion engine, a valve control mechanism which comprises:

a camshaft carrying a plurality of cams;

an input member coupled to the camshaft for rotating the camshaft;

means for varying the axial position of the camshaft relative to the input member; and a cam follower for each cam, each cam follower comprising a body which reciprocates in a respective slideway, the body having an abutment face which acts upon the end of a respective single valve stem, wherein each cam follower is disposed relative to a respective valve stem such that the abutment face of each cam follower contacts the end of its respective valve stem at a zone of action that is located away from the mid-point, measured in a direction parallel to the axis of the camshaft, of a section through the cam follower in a plane which contains the axis of the camshaft and the axis of the valve stem.

2. A valve control mechanism as claimed in claim 1, wherein said means for varying the axial position of said camshaft comprise a piston housed and axially displaceable within a cylinder, the axial position of said piston in the cylinder being under hydraulic control, said piston being connected to the camshaft so that axial displacement of the piston causes axial displacement of the camshaft relative to a camshaft support, the camshaft being coupled, outside the cylinder, to the input member by a mechanical coupling which rotates the camshaft relatively to the input member when the camshaft is moved axially upon displacement of the piston in the cylinder.

3. A valve control mechanism as claimed in claim 2, wherein said input member comprises a camshaft pulley, and said piston and cylinder are housed within the camshaft pulley at the front end of the camshaft.

4. A valve control mechanism as claimed in claim 3, wherein said cylinder is defined, at its front end, by a front plate having an annular flange extending towards the camshaft; and at its rear end by the front face of a housing within which said mechanical coupling is housed.

5. A valve control mechanism as claimed in claim 4, wherein said mechanical coupling comprises a spline mechanism acting between said housing and the front end of said camshaft.

6. A valve control mechanism as claimed in claim 4, wherein a first channel is provided to deliver hydraulic fluid to the interior of said cylinder directly behind said front plate, and a second channel is provided to deliver hydraulic fluid to said cylinder directly in front of the housing for said mechanical coupling.

7. A valve control mechanism as claimed in claim 5, wherein axial displacement of said piston causes a corresponding degree of rotational advancement of the camshaft relative to the input member when the axial movement is in one direction and a limited degree of rotational retardation of the camshaft relative to the input member when the axial movement is in the opposite direction.

8. A valve control mechanism as claimed in claim 1, wherein the profile of each cam is such that a line connecting the points of maximum radial extent of the cam at opposite ends thereof, as viewed in the direction of the camshaft axis, is non-parallel to the axis of the camshaft.

9. A valve control mechanism as claimed in claim 1, wherein the cam follower has at its extremity opposite the abutment face a trough of curved cross-section which receives a member in the form of a segment having on one side thereof a surface curved correspondingly to that of said trough, and having on the other side thereof a planar surface, whereby the curved surface of the segment enables said member to turn with respect to said body, while the planar surface of the member cooperates with the cam surface.

10. An engine as claimed in claim 1, wherein said zone of action is located close to one side of the cam follower.

11. A valve control mechanism as claimed in claim 1, wherein said end of the valve stem is partly recessed within the body of the cam follower.

12. A valve control mechanism as claimed in claim 1, wherein each cam follower has a first dimension in a direction parallel to the camshaft which is smaller than a second dimension in a direction perpendicular to the first direction and perpendicular to the valve stem, each cam follower being disposed relative to the single valve stem on which said cam follower acts such that contact between the respective abutment face and the valve stem occurs away from the mid point of said first.

13. A valve control mechanism as claimed in claim 12 wherein each cam follower is a generally rectangular, hollow body having a side wall, an upper end adapted to contact the respective cam and a lower end provided with a contact surface for cooperation with the single valve stem on which said cam follower acts, said contact surface being located close to the side wall.

14. A valve control mechanism as claimed in claim 2, wherein the hydraulic control of said piston is governed by a microprocessor.

15. A valve control mechanism as claimed in claim 2, wherein the camshaft support comprises a cylindrical projection having an external surface on which the input member is supported by means of a first bearing, the camshaft being supported, at its end adjacent the input member, by a second bearing in a bore in the camshaft support.

16. A valve control mechanism as claimed in claim 15, wherein the cylinder is disposed within the cylindrical projection.

17. A valve control mechanism as claimed in claim 15, wherein the input member has an axial end face directed away from the camshaft, the cylinder being disposed between the axial end face and the camshaft.

18. A valve control mechanism as claimed in claim 15, wherein the housing constitutes the second bearing.

19. An internal combustion engine comprising a valve control mechanism as claimed in claim 5, wherein the piston, cylinder and spline mechanism are positioned at the front end of the camshaft.

20. A valve control mechanism as claimed in claim 5, wherein said spline mechanism is a ball spline.

21. In or for use in an internal combustion engine, a valve control mechanism which comprises:

(1) a camshaft carrying a plurality of cams;

(2) an input member coupled to the camshaft for rotating the camshaft;

(3) means for varying the axial and rotational position of the camshaft relative to the input member, (4) a cam follower for each cam, each cam follower comprising a body which reciprocates in a respective slideway, the body having an abutment face which acts upon the end of a respective single valve stem, and having a first dimension in a direction parallel to the camshaft which is smaller than a second dimension in a direction perpendicular to the first direction and perpendicular to the valve stem, wherein the cam followers are disposed relatively to the respective valve stems such that contact between the respective abutment face and the valve stem occurs away from the mid point of the said smaller dimension.

* * * * *